United States Patent [19]

Rodriguez et al.

[11] 4,405,332

[45] Sep. 20, 1983

[54] ALTERNATIVE FUEL COMPRISED OF SEWAGE SLUDGE AND A PARTICULATE SOLID FUEL

[76] Inventors: Larry A. Rodriguez, 7452 18th St. NE., St. Petersburg, Fla. 33702; Antonio A. Padilla, 15803 Deep Creek La., Tampa, Fla. 33624; Robert A. Ashworth, 1017 41st Ave. NE., St. Petersburg, Fla. 33703; Ned B. Spake, 2711 Summerfield Rd., Winter Park, Fla. 32792

[21] Appl. No.: 287,581

[22] Filed: Jul. 28, 1981

[51] Int. Cl.[3] ..... C10L 1/32

[52] U.S. Cl. ..... 44/51; 44/50

[58] Field of Search ..... 44/51, 1 D; 210/603, 210/769, 631

[56] References Cited

U.S. PATENT DOCUMENTS

| | | | |
|---|---|---|---|
| 3,166,032 | 1/1965 | Klesper . | |
| 3,168,350 | 2/1965 | Phinney et al. . | |
| 3,300,403 | 1/1967 | Kehoe | 210/609 |
| 3,524,682 | 8/1970 | Booth . | |
| 3,637,263 | 1/1972 | Wasp . | |
| 3,660,054 | 5/1972 | Rieve . | |
| 3,719,397 | 3/1973 | Wasp . | |
| 3,759,196 | 9/1973 | Spaite . | |
| 3,762,887 | 10/1973 | Clancey et al. . | |
| 3,933,634 | 1/1976 | Seki | 210/710 |
| 3,950,034 | 4/1976 | Dreher et al. . | |
| 3,996,026 | 12/1977 | Cole . | |
| 4,104,035 | 8/1978 | Cole et al. . | |
| 4,135,888 | 1/1979 | Waltrip | 44/1 D |
| 4,159,684 | 7/1979 | Kirkup | 110/346 |
| 4,164,396 | 8/1979 | Jones . | |
| 4,242,098 | 12/1980 | Braun et al. . | |

FOREIGN PATENT DOCUMENTS

| | | |
|---|---|---|
| 691488 | 7/1964 | Canada . |
| 272981 | 6/1927 | United Kingdom . |
| 949000 | 2/1964 | United Kingdom . |
| 1198958 | 7/1970 | United Kingdom . |
| 1286532 | 8/1972 | United Kingdom . |

OTHER PUBLICATIONS

Farris, R., "Prediction of the Viscosity of Multimodal Suspensions from Unimodal Viscosity Data", *Transactions of the Society of Rheology,* 12:2, pp. 281–301, 1968.

*Primary Examiner*—Charles F. Warren
*Assistant Examiner*—Y. Harris-Smith
*Attorney, Agent, or Firm*—Burns, Doane, Swecker & Mathis

[57] ABSTRACT

An improved fuel composition is provided comprising in minor proportion a non-dewatered sewage sludge and in major proportion a particulate solid fuel. A method is also provided for the incineration of sewage sludge comprising providing a pumpable admixture of a non-dewatered sewage sludge and a particulate solid fuel and incinerating the admixture.

6 Claims, 3 Drawing Figures

ALTERNATIVE FUEL COMPRISED OF SEWAGE SLUDGE AND A PARTICULATE SOLID FUEL

BACKGROUND OF THE INVENTION

The present invention is directed to a fuel comprised of sewage sludge and a solid particulate fuel.

In an effort to reduce oil consumption due to increasing oil prices and questionable future sources of supply, industry has begun to convert from oil-fired boilers to boilers which are fired by alternative fuels such as particulate coal, coal-water and coal-oil mixtures. Admixtures of coal with suitable liquids such as water and oil are attractive as alternative fuels since such pumpable admixtures are relatively easily adapted for use with oil-fired boilers. This is in contrast to the effort which is required to convert an oil-fired boiler to a coal-fired boiler. Exemplary disclosures of coal-water fuels are provided by U.S. Pat. No. 3,660,054 (issued to Rieve), U.S. Pat. No. 3,762,887 (issued to Clancey et al) and U.S. Pat. No. 4,104,035 (issued to Cole et al).

It is also known that alternative fuels may be comprised of a coal-sewage admixture which is processed prior to burning for various reasons such as to decrease the moisture content thereof, etc. See, for example, U.S. Pat. No. 3,166,032 (issued to Klesper); U.S. Pat. No. 4,135,888 (issued to Waltrip); and U.S. Pat. No. 4,159,684 (issued to Kirkup) and British Pat. No. 949,000 (issued to Passavant el al). However, the production of such coal-sewage fuels requires significant processing and results in a substantially non-pumpable fuel which possesses the above-noted disadvantages of fuels comprised substantially of particulate coal.

However, it would be an advantage to provide an alternative fuel comprised of a solid fuel such as particulate coal and a relatively readily available waste material, such as sewage, which provides the advantages of pumpable coal-containing fuels while avoiding the disadvantages of substantially solid particulate fuels.

It would also be an advantage to provide an improved method for the disposal of sewage sludge which avoids the need for conventionally employed methods whereby the sewage sludge is treated and eventually discarded in landfills, etc. Such methods are costly, time-consuming and prevent valuable land from being used for more beneficial purposes.

OBJECTS AND SUMMARY OF THE INVENTION

It is therefore an object of the present invention to provide an improved combustible fuel.

It is also an object of the present invention to provide an improved pumpable combustible fuel having an increased BTU content.

It is still another object of the present invention to provide a pumpable combustible fuel which does not require the addition of extraneous water.

It is still yet another object of the present invention to provide a pumpable combustible fuel within which a particulate fuel may be more readily suspended.

It is still yet another object of the present invention to provide a combustible fuel which can be readily adapted for use with existing oil-fired boilers.

It is still another object of the present invention to provide an improved method for the disposal of sewage sludge.

It is still further an object of the present invention to overcome the disadvantages of the prior art discussed above.

In accordance with one aspect of the present invention, there is thus provided an improved fuel composition comprising in minor proportion a non-dewatered sewage sludge and in major proportion a particulate solid fuel.

In accordance with another aspect of the present invention, there is provided a method for the incineration of sewage sludge comprising providing a pumpable admixture of a non-dewatered sewage sludge and a particulate solid fuel and incinerating the admixture.

DETAILED DESCRIPTION OF THE INVENTION

Figure 1:
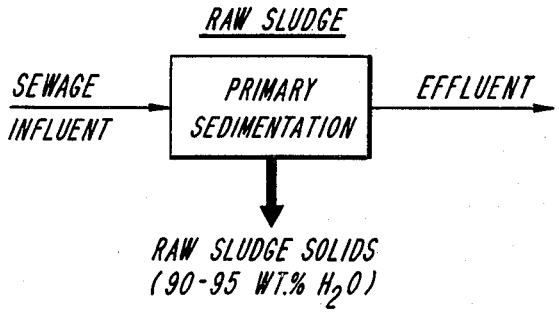
FIGS. 1–3 depict schematically various conventional methods for the treatment of raw sewage.

It has been surprisingly and unexpectedly found that an admixture of non-dewatered sewage sludge and a particulate solid fuel such as coal is well suited for use as a combustible fuel.

The combustible fuel admixture of the present invention provides many advantages. For instance, sewage sludge is generally readily available and its use in such an admixture enables disposal problems to be simplified by avoiding the use of landfills and expensive purification processes. In addition, the use of non-dewatered sewage sludge enables a pumpable fuel admixture to be provided which does not require the addition of extraneous water from other sources. It is therefore possible to conserve the increasingly valuable amount of water which is available for general consumption. Furthermore, additional sources of combustible materials (resulting in a higher BTU value for the fuel) are provided by use of the non-dewatered sewage sludge which compensates for the heat of vaporization disadvantageously withdrawn from the combustion process by the vaporization of the water present therein.

The combustible fuel of the present invention may be comprised of any suitable solid particulate fuel. The solid particulate fuel typically comprises a major proportion of the admixture, such as from about 60 to 75 percent by weight, and preferably comprises about 75 percent by weight of the combustible fuel admixture.

The solid fuel which is employed can comprise coal of various types (anthracite, bituminous, sub-bituminous, lignite), petroleum coke, by-product coke, charcoal, humate, peat, wood or other suitable solid fuels. Mixtures of such fuels may also be employed. Coal is the preferred solid fuel. The above listing is not intended to be all-inclusive and one skilled in the art can determine which types of solids can be employed as the fuel component in the present invention.

The solid fuel is desirably processed to reduce the solid particle size thereof to a point that insures good fuel combustion and carbon conversion upon firing the fuel in a boiler. The solid fuel size consist will generally be in the range of 100 wt% minus 8 mesh (0.0957 in.) to 100 wt% minus 325 mesh (44 microns). A typical size distribution for a solid fuel being of a size within the range cited above is shown in Table 1 below. The size distribution of the solid fuel is not critical and may vary widely. For example, the particle size distribution may either be uniformly distributed over the above range or concentrated at either end thereof.

TABLE 1

| TYPICAL SOLID FUEL SIZE CONSIST | |
|---|---|
| UPPER PARTICLE SIZE RANGE | −8 MESH GRIND, WT % |
| −8 mesh, +14 mesh | 15.0 |
| −14 mesh, +28 mesh | 30.0 |
| −28 mesh, +48 mesh | 20.0 |
| −48 mesh, +100 mesh | 14.0 |
| −100 mesh, +200 mesh | 6.0 |
| −200 mesh, +325 mesh | 4.0 |
| −325 mesh | 11.0 |
| TOTAL | 100.0% |
| LOWER PARTICLE SIZE RANGE | −325 MESH GRIND, WT % |
| −325 mesh (44μ), +20μ | 12.0 |
| −20μ, +10μ | 46.0 |
| −10μ, +5μ | 34.0 |
| −5μ | 8.0 |
| TOTAL | 100.0% |

The sewage sludge component of the fuel admixture of the present invention typically comprises a minor proportion of the admixture, such as from about 25 to 40 percent by weight, and preferably comprises about 25 percent by weight of the fuel admixture. The sewage sludge generally consists of about 85 to 99.5 percent by weight of water and from about 0.5 to 15 percent by weight of combustible or volatile solids. Such sewage sludge comprises, in essence, sludge which has not been dewatered to any significant extent. A non-dewatered sludge for purposes of the present invention is intended to refer to a sludge which contains at least about 85 percent by weight of water.

Sewage sludge is the mixture of sewage (i.e., contaminated water) and settled solids. As a result of the type of treatment received, it may be designated as raw or fresh, digested, activated, dewatered, or dried. Other descriptive terms include elutriated, Imhoff, and septic-tank sludge.

Figure 2:
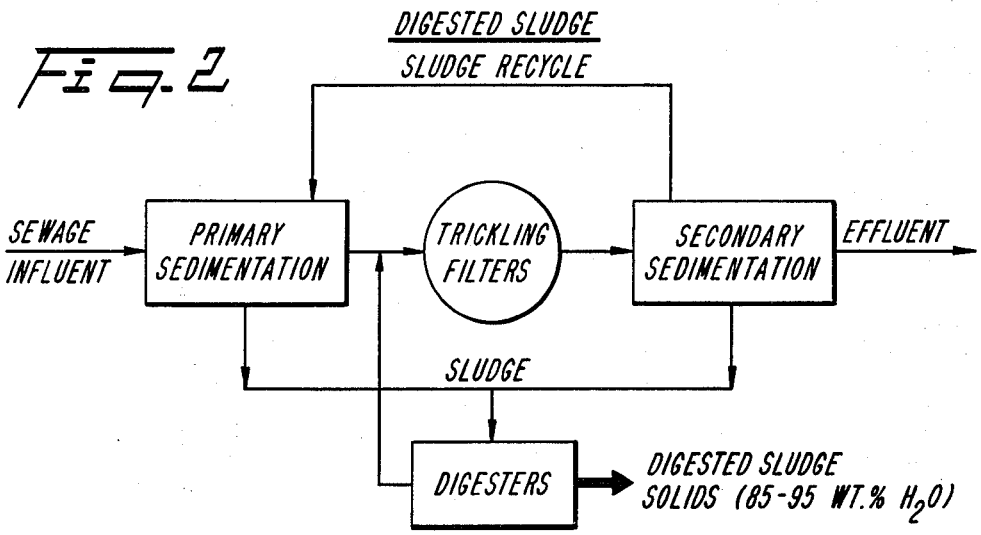
Figure 3:
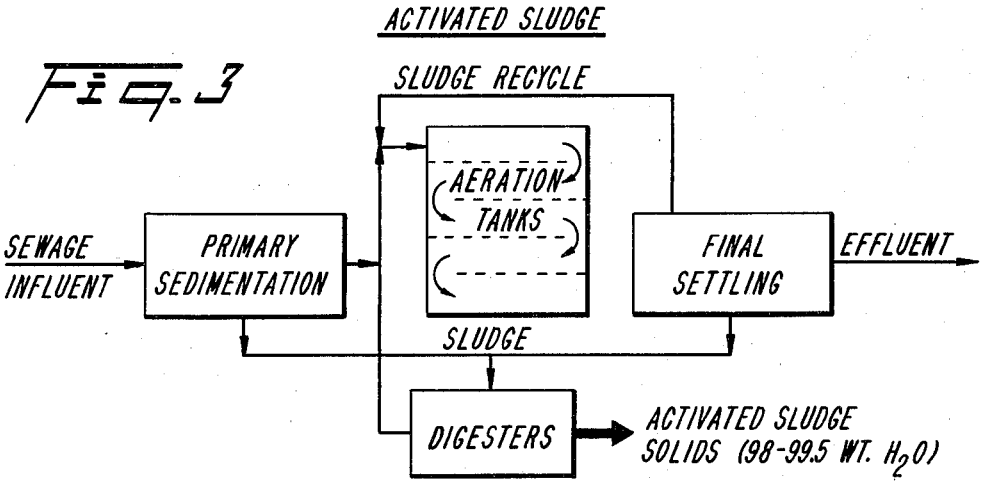

The present invention concerns primarily the utilization of non-dewatered sludge. Therefore, the sludge to be admixed with the solid fuel would, in most cases, be raw, digested, or activated sludge. However, there may be situations where it could be efficacious to mix water with dewatered or dried sludge in order to dispose of the sludge (in a "non-dewatered" form) by the method of the present invention. A typical flow diagram depicting conventional methods for the production of raw, digested, or activated sludge solids is shown in FIGS. 1, 2 and 3.

Raw sludge solids are produced by plain sedimentation. Digested and activated sludge solids are produced from the secondary treatment of sewage. The digested and activated sludge treatment processes both depend on aerobic biological organisms to effect decomposition. The only difference between the two processes is the method of operation. Digested sludge treatment employs trickling filters wherein the organisms attach themselves to the filters and the organic material (sewage) is pumped through the organism for the digestion process. In the activated sludge treatment process, the organisms are migrant and are thoroughly mixed with the organic matter to effect digestion.

The quantity and composition of sludge varies with the character of the sewage from which it is removed. It also is dependent on the type of treatment that it receives. Typical concentrations and analyses of the solids for various sewage sludges are shown in Table 2. The properties and concentrations of inorganic and organic constituents of whole raw sewage (as a fuel to a treatment plant) are shown in Table 3.

TABLE 2

CONCENTRATION AND ANALYSIS OF VARIOUS TYPES OF SLUDGE SOLIDS

| CONSTITUENT, WT % | RAW | DIGESTED | ACTIVATED |
|---|---|---|---|
| Solids, Total | 5–10 | 5–15 | 0.5–2 |
| Solids, Dry Basis: | | | |
| Volatile Matter | 55–80 | 40–60 | 62–75 |
| Ash | 20–45 | 40–60 | 25–38 |
| Insoluble Ash | 15–35 | 30–50 | 22–30 |
| Grease and Fats | 5–35 | 2–17 | 5–12 |
| Protein | 20–28 | 14–30 | 32–41 |
| Ammonium Nitrate | 1–3.5 | 1–4 | 4–7 |
| Phosphoric Acid | 1–1.5 | 0.5–3.7 | 3–4 |
| Potash | | 0–4 | 0.86 |
| Cellulose | 8–13 | 8–13 | 7.8 |
| Silica | | 15–16 | 8.5 |
| Iron | | 5.4 | 7.1 |

Gross Heating Value, Btu/Lb (dry basis) 7250

TABLE 3

PROPERTIES AND CONSTITUENTS OF DOMESTIC RAW SEWAGE

| CHARACTERISTIC | RANGE |
|---|---|
| pH | 6.7–7.5 |
| BOD, mg/l | 46–276 |
| COD, mg/l | 97–443 |
| Total Solids, mg/l | 294–676 |
| Suspended Solids, mg/l | 58–258 |
| Volatile Solids, mg/l | 54–208 |
| CONSTITUENT | CONCENTRATION, mg/l (value) |
| Sugars | 10.0 |
| Nonvolatile Acids | 28.5 |
| Volatile Acids | 0.3 |
| Amino Acids, Total | 9.0 |
| Detergents | 4.0 |
| Uric Acid | 0.33 |
| Phenols | 0.11 |
| Cholesterol | 0.04 |
| Creatine-Creatinine | 0.18 |
| Cl | 20.1 |
| Si | 3.9 |
| Fe | 0.8 |
| Al | 0.13 |
| Ca | 9.8 |
| Mg | 10.3 |
| K | 5.9 |
| Na | 23.0 |
| Mn | 0.47 |
| Cu | 1.56 |
| Zn | 0.36 |
| Pb | 0.48 |
| S (all forms) | 10.3 |
| Phosphate (As P) | 6.6 |

Additional advantages are provided by the use of sewage sludge in the present invention. It is well known that the addition of surfactants (e.g., detergents) to water decreases the surface tension of the water. The decrease in surface tension results in an increased wetting action of the water. Therefore, non-dewatered sludge, due to the presence of detergents therein (see Table 3), will exhibit improved wetting characteristics in comparison to water. The mixing of fine solid fuel particles throughout the sludge will therefore be improved in comparison to the use of water along.

It has also been disclosed (See, for example, U.S. Pat. No. 3,950,034, issued to Dreher et al) that electrolytes improve the viscosity characteristics of solid fuel/liquid mixtures. Compounds which act as electrolytes include inorganic salts, inorganic bases, inorganic acids or a combination thereof. Ammonium nitrate and phosphoric acid, both found in sewage sludge, act as electrolytes. Therefore, the viscosity characteristics of a solid fuel-sewage sludge mixture will be improved compared to solid fuel-water compositions. This means that for the same concentration of solids/liquids, the viscosity of a solid fuel-sludge mixture will be lower than that for a solid fuel-water mixture.

The concentration of solids in the sewage sludge is not critical. Depending upon whether the solids concentration is high or low, the concentration of the solid fuel in the fuel admixture can accordingly be increased or reduced to accommodate the change in concentration of the sludge solids. The important aspect with respect to the solid fuel:liquid mixture ratios is the pumpability of the mix. Mixtures which exhibit very high viscosity characteristics become impractical to transport via pumping because of high pressure drop in the pipeline, or in the extreme, complete inability to move the mixture by pumping. Desirable proportions of the solid fuel to the non-dewatered sludge thus will generally range from about 60/40 to about 75/25 depending on the tested viscosity characteristics of specific solid fuels and sludges.

The combustible fuel admixture may be formed by admixing the non-dewatered sewage sludge with the particulate solid fuel in suitable proportions. The respective components are desirably admixed thoroughly by suitable means such as agitation to ensure that the particulate solid fuel is well dispersed within the sewage sludge. A thorough admixing of the solid fuel within the sludge minimizes settling of the solid fuel and enables the admixture to be pumped without unnecessary difficulty.

The solid fuel will generally be easily maintained in suspension within the sewage sludge due to the physical composition and viscosity of the sludge. It may, however, be advantageous to add various additives to the fuel admixture to further enhance the dispersal of the solid fuel within the sludge. The use of such additives with coal-water slurries is conventional and various types of additives may be employed. See, for example, U.S. Pat. No. 3,542,682 (issued to Booth) and U.S. Pat. No. 4,242,098 (issued to Braun et al), each incorporated herein by reference in its entirety.

The combustible fuel admixture of the present invention can be utilized as a fuel source for a variety of applications such as boilers which are employed in the generation of electrical power. The fuel can be directly substituted for conventional coal-water or coal-oil slurry fuels or admixed therewith in various proportions. The sewage sludge is incinerated substantially completely during the combustion process which enables the combustion of the fuel admixture to serve as a viable disposal method for sewage sludge.

A comparative heating value analysis of coal-water, coal-sludge, and a typical coal-oil mixture is shown in Table 4. As can be seen from the tabulation, the coal-sludge fuel of the present invention is comparable to a coal-water fuel in terms of heating value. However, there is a slight improvement in utilization of the heating fuel since the sludge (in contrast to water) has an inherent heating value. Coal-oil fuels will exhibit much higher heating values in comparison to the coal-sludge and coal-water fuels due to the significant heating value of the oil. The coal-sludge and coal-water fuels will produce lower $NO_x$ values during combustion in comparison to coal-oil fuels, assuming like conditions, since the flame temperature will be lower than the coal-oil mixtures due to the addition of the non-fuel (i.e., water) and high heat of vaporiation of the water contained therein.

TABLE 4

COMPARATIVE GROSS HEATING VALUE FUEL ANALYSIS

| FUEL | WEIGHT FRACTION | BTU/LB | BTU |
|---|---|---|---|
| A. Coal-Sludge: | | | |
| Sludge Solids | 0.066 | 7,250 | 47.9 |
| Sewage Water | 0.2434 | 1.7 | 0.4 |
| Coal | 0.7500 | 12,545 | 9,408.7 |
| TOTAL | 1.0000 | | 9,457.0 |
| B. Coal-Water: | | | |
| Water | 0.2500 | 0 | 0 |
| Coal | 0.7500 | 12,545 | 9,408.7 |
| TOTAL | 1.0000 | | 9,408.7 |
| C. Coal-Oil: | | | |
| Oil | 0.5000 | 18,080 | 9,040.0 |
| Coal | 0.5000 | 12,545 | 6,272.5 |
| TOTAL | 1.0000 | | 15,312.5 |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. An improved fuel composition comprising from about 25 to 40 percent by weight of non-dewatered sewage sludge and from about 60 to 75 percent by weight of a particulate solid fuel, said non-dewatered sewage sludge comprising from about 85 to 99.5 percent by weight of water and from about 0.5 to 15 percent by weight of combustible solids.

2. The fuel composition of claim 1 wherein said solid fuel is selected from the group consisting of coal, petroleum coke, by-product coke, charcoal, humate, peat, wood and mixtures thereof.

3. The fuel composition of claim 2 wherein said solid fuel is coal.

4. The fuel composition of claim 1 wherein said particulate solid fuel is of a size ranging from about 100% minus 8 mesh to about 100% minus 325 mesh.

5. The fuel composition of claim 1 further comprising an additive to aid in maintaining said particulate fuel in suspension.

6. The fuel composition of claim 1 comprising about 25 percent by weight of said sewage sludge and about 75 percent by weight of said particulate solid fuel.

* * * * *